US006199520B1

(12) United States Patent
Warren

(10) Patent No.: US 6,199,520 B1
(45) Date of Patent: Mar. 13, 2001

(54) TWO STROKE ENGINE WITH DISPLACER

(76) Inventor: Edward Lawrence Warren, 3912 Snowy Egret Rd., West Melbourne, FL (US) 32904

( * ) Notice: Subject to any disclaimer, the term of this patent is extended or adjusted under 35 U.S.C. 154(b) by 0 days.

(21) Appl. No.: 09/383,605

(22) Filed: Aug. 26, 1999

(51) Int. Cl.[7] ..... F02G 5/00
(52) U.S. Cl. ..... 123/48 R; 123/48 AA
(58) Field of Search ..... 123/48 R, 48 A, 123/48 AA

(56) References Cited

U.S. PATENT DOCUMENTS

| | | | | |
|---|---|---|---|---|
| 4,241,703 | * | 12/1980 | Lin-Liaw | 123/48 R |
| 4,284,055 | * | 8/1981 | Wakeman | 123/556 |
| 5,024,184 | * | 6/1991 | Nagano et al. | 123/48 R |
| 5,063,883 | * | 11/1991 | Dinges | 123/48 R |
| 5,465,702 | * | 11/1995 | Ferrenberg | 123/543 |
| 5,540,191 | * | 7/1996 | Clarke | 123/541 |
| 5,632,255 | * | 5/1997 | Ferrenberg | 123/543 |

FOREIGN PATENT DOCUMENTS

| | | | | |
|---|---|---|---|---|
| 0029733 | * | 2/1987 | (JP) | 123/48 R |
| 0216033 | * | 8/1989 | (JP) | 123/48 R |
| 406280609 | * | 10/1994 | (JP) | 123/48 R |

* cited by examiner

*Primary Examiner*—Marguerite McMahon
*Assistant Examiner*—Jason Benton

(57) ABSTRACT

A two stroke, internal combustion, reciprocating, engine with a displacer 11 made up of a number of similar working units. Each working unit is comprised of a cylinder 12 that is closed at one end by cylinder head 4, and contains exhaust port 34, compressed air chamber 13, air inlet valve 2, power piston 18 that is connected to power output shaft 22, and displacer 11. Displacer 11 moves between power piston 18 and cylinder head 4, and the means to accomplish this are: spring 10, the urging of power piston 18 after a collision, and the difference between the internal and external pressures. During the compression stroke the pressure inside the engine exceeds the pressure outside of the engine, this pressure difference, along with power piston 18 urging displacer 11, forces displacer 11 up against cylinder head 4 and deforms spring 10. Heat is added in compressed air chamber 13. During the expansion stroke the pressure difference continues to keep displacer 11 up against cylinder head 4 and spring 10 deformed. Near the end of the expansion stroke power piston 18 reaches exhaust port 34. When power piston 18 reaches exhaust port 34 and releases the pressure from inside the engine, spring 10 resumes its undeformed state and moves displacer 11 towards power piston 18. While displacer 11 moves toward power piston 18, displacer 11 sucks in the working fluid and pushes out the exhaust gases from cylinder 12. Power piston 18 meets displacer 11, covers exhaust port 34 and compression begins. To provide regeneration, in an alternative embodiment, an alternating flow heat exchanger, called movable regenerator 32, is attached to displacer 11.

10 Claims, 12 Drawing Sheets

TWO STROKE ENGINE WITH DISPLACER

BACKGROUND—FIELD OF INVENTION

The present invention relates to, reciprocating, two stroke internal combustion engines with displacers.

BACKGROUND—DESCRIPTION OF PRIOR ART

The approach taken by most inventors is that they improve existing designs (crankcase compression or the use of external compression) instead of using a displacer to aid in the intake and exhausting of air and products of combustion. With crankcase compression engines, no scavenging of the cylinder is possible, the volumetric efficiency is low (30 to 50 percent), and the engine is limited to operation at low piston speed (usually less than 1,000 fpm) for economical operation. Other inventors who have introduced displacers into their engines use linkages from the power piston to move the displacer. This includes the present inventor in his patent application "A Two Stroke Regenerative Engine", Ser. No. 09/354670 dated Jul. 16, 1999. It also includes Hutchinson (1920, U.S. Pat. No. 1,440,150), Wagner (1914, U.S. Pat. No. 1,186,350), and Gile (1920, U.S. Pat. No. 1,335,324). What is needed is a new engine that moves the displacer without a linkage from the power piston. The present invention has no linkage between the power piston and the displacer. The exhaust port is uncovered and recovered by the position of the power piston. The displacer is moved by collision with the power piston and subsequent urging by the power piston, pressure forces and spring forces. The preferred embodiment of the present invention has no linkage between the power piston and the displacer to move the displacer.

SUMMARY

This invention is a two stroke, internal combustion, reciprocating, engine with a displacer, made up of a number of similar working units. Each working unit is comprised of a cylinder that is closed at one end by a cylinder head, and contains a compression chamber, an air inlet valve, a power piston that is connected to a power output shaft, and a displacer. The displacer is a movable wall with a cylinder attached to it. This displacer moves between the power piston and the cylinder head, and the means to accomplish this are: a spring, the urging of the power piston after a collision, and the difference between the internal and external engine pressures. During the compression stroke the pressure inside the engine exceeds the pressure outside of the engine, this pressure difference forces the displacer up against the cylinder head and deforms the spring. During the expansion stroke the pressure difference continues to keep the displacer up against the cylinder head and the spring deformed. Near the end of the expansion stroke the piston reaches the exhaust port. When the piston reaches the exhaust port the pressure is released from inside the engine. Since the spring is connected to the displacer, the spring resuming its undeformed state moves the displacer towards the power piston. While the displacer moves toward the power piston the displacer sucks in the working fluid and pushes the exhaust gases out of the cylinder. After the meeting of the power piston and the displacer and the recovering of the exhaust port, compression begins.

To provide regeneration in an alternative embodiment an alternating flow heat exchanger, called a regenerator, is attached to the displacer.

OBJECTS AND ADVANTAGES

Several objects and advantages of the engine with a displacer are:

(a) The engine compresses the air in the same cylinder that the engine expands the air in.

(b) The engine compresses the air in a portion of the cylinder that is not heated by the hot gases.

(c) The engine allows the compressed air to be cooled.

(d) In an alternative embodiment, the engine saves the heat from the exhaust gases and releases the heat to the compressed air.

(e) In an alternative embodiment, all of the engines valves operate at compressor exit temperature or slightly higher.

(f) The engine exhausts most of the exhaust gases each stroke.

(g) The engine can be operated so that the charge is almost fully expanded.

(h) In the preferred embodiment, the engine has no linkage between the displacer and the power piston.

DRAWING FIGURES

Figure 4:
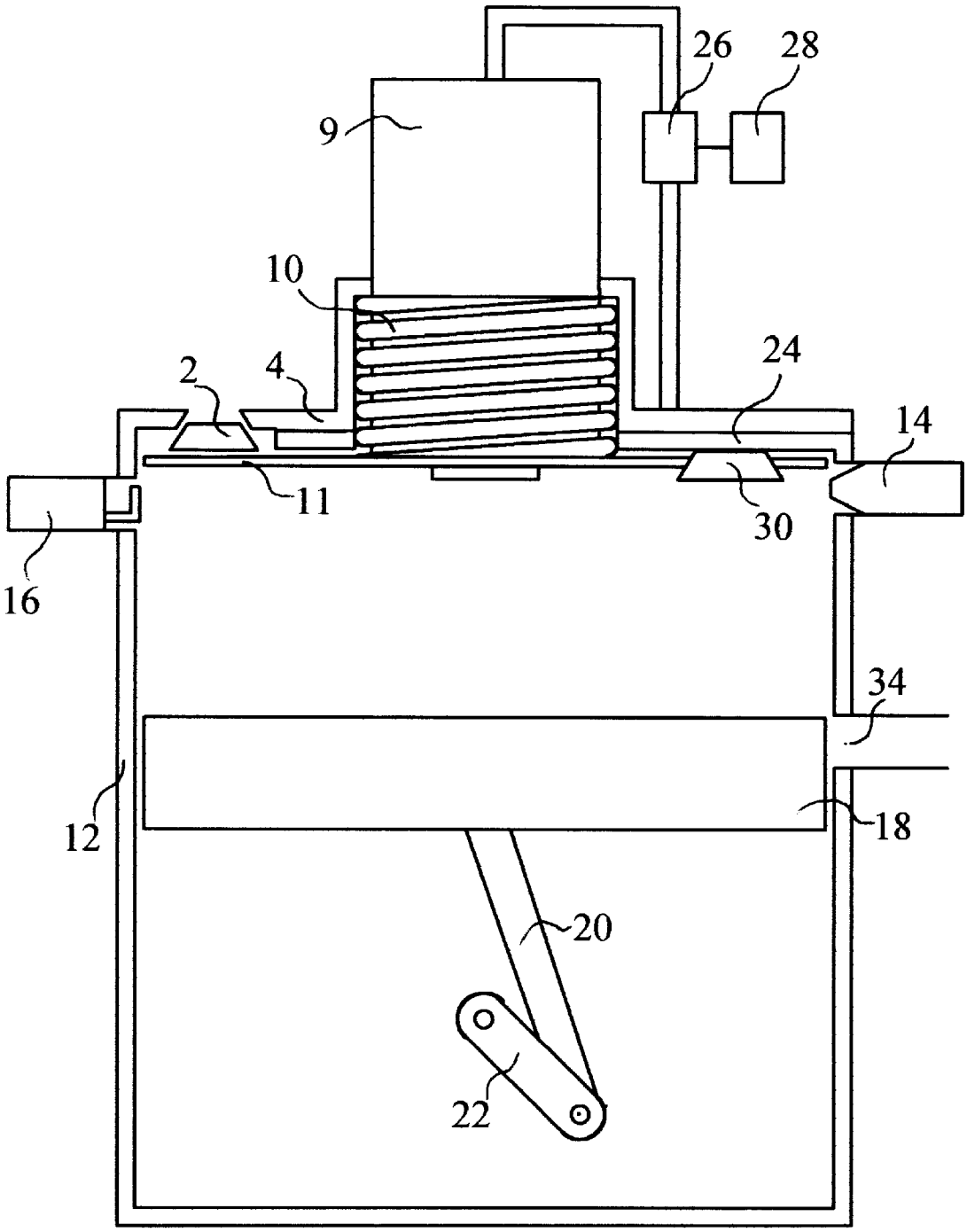

FIG. 4 depicts the first alternate embodiment of the invention. It is the preferred embodiment of the invention with compression chamber 13 removed and displacer valve 30 added. It is at the start of the inlet and exhaust part of the cycle.

Figure 5:
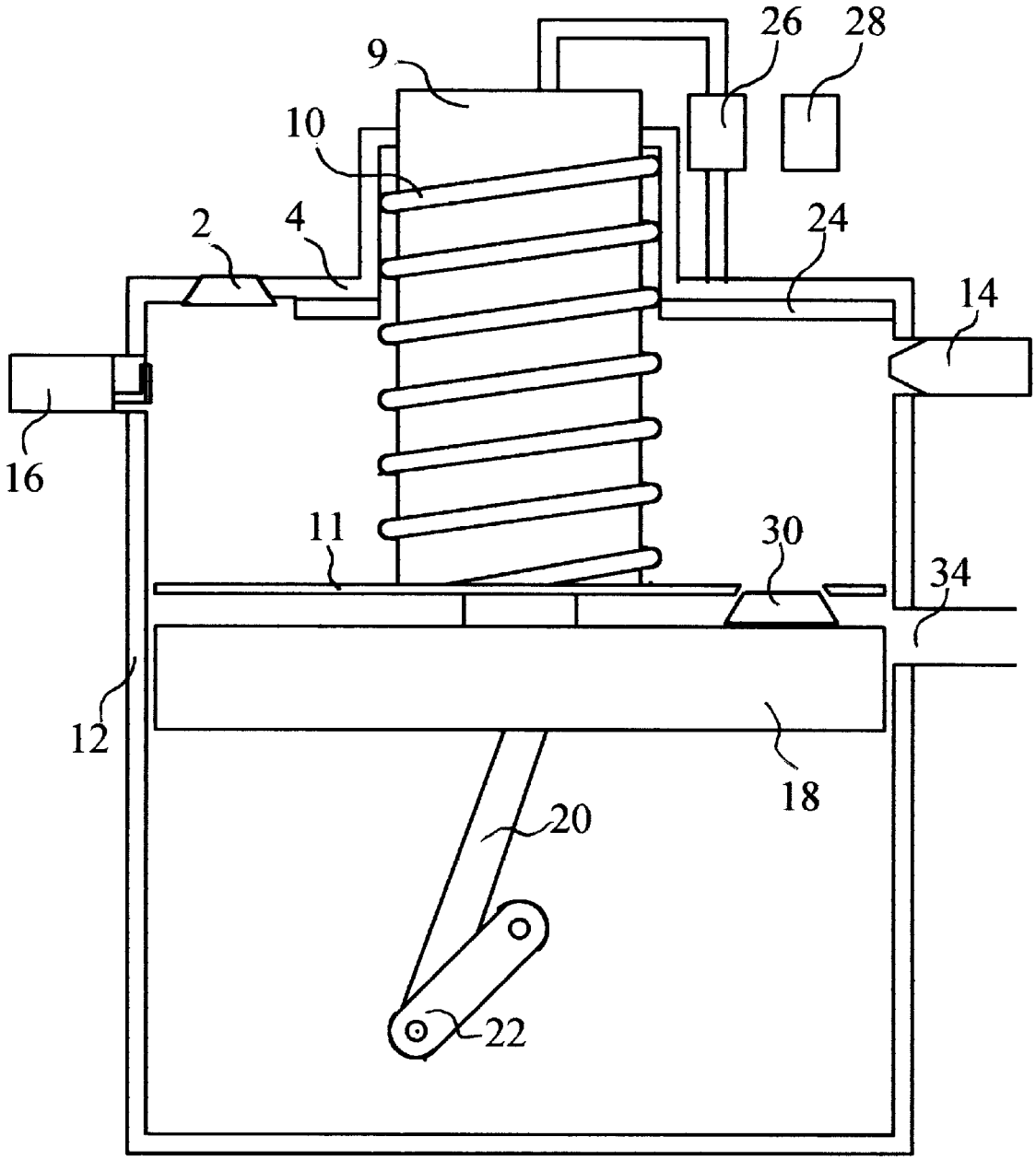

FIG. 5 depicts the first alternate embodiment of the invention. It is at the start of the compression part of the cycle.

Figure 6:
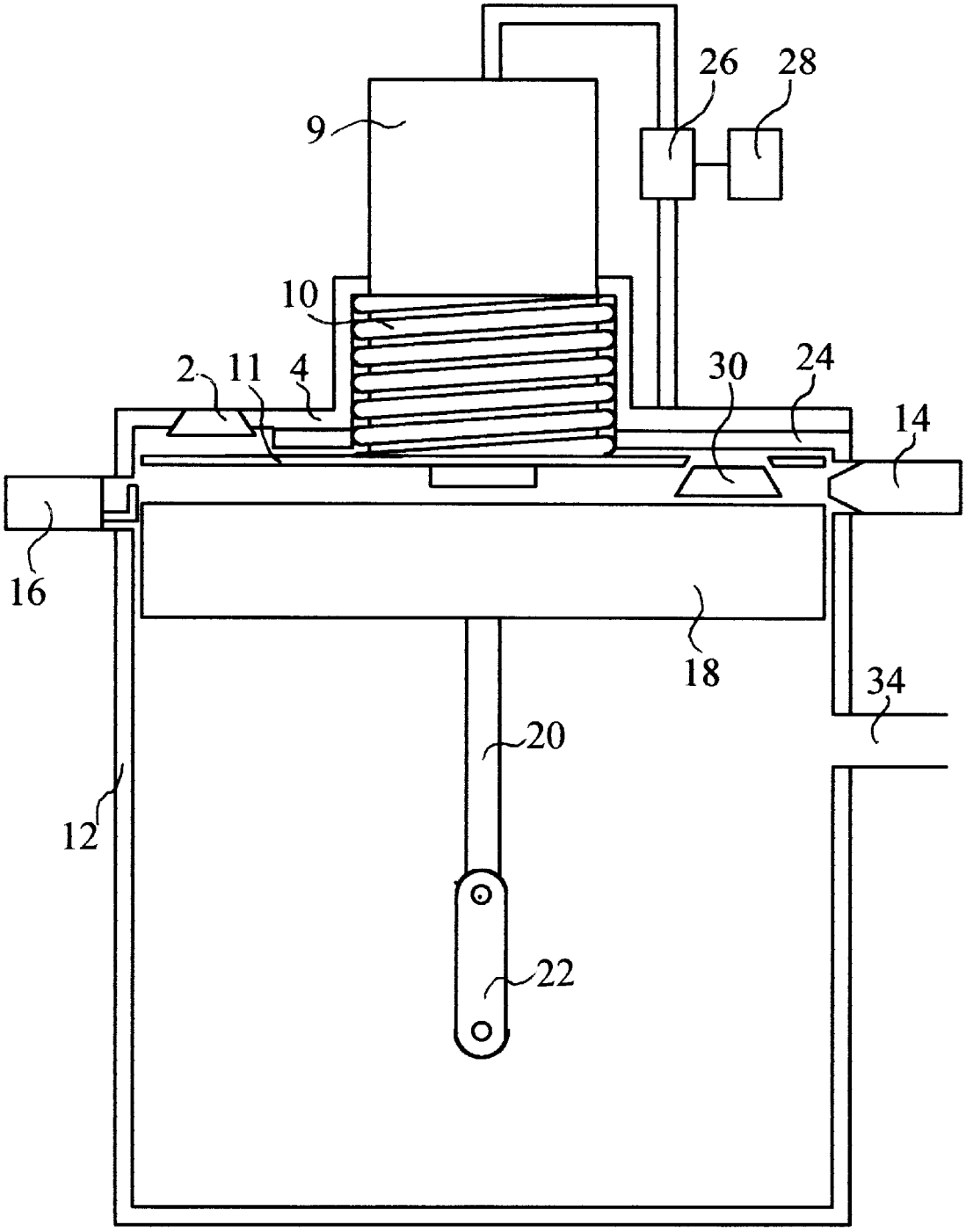

FIG. 6 depicts the first alternate embodiment of the invention. It is at the start of the expansion part of the cycle.

Figure 7:
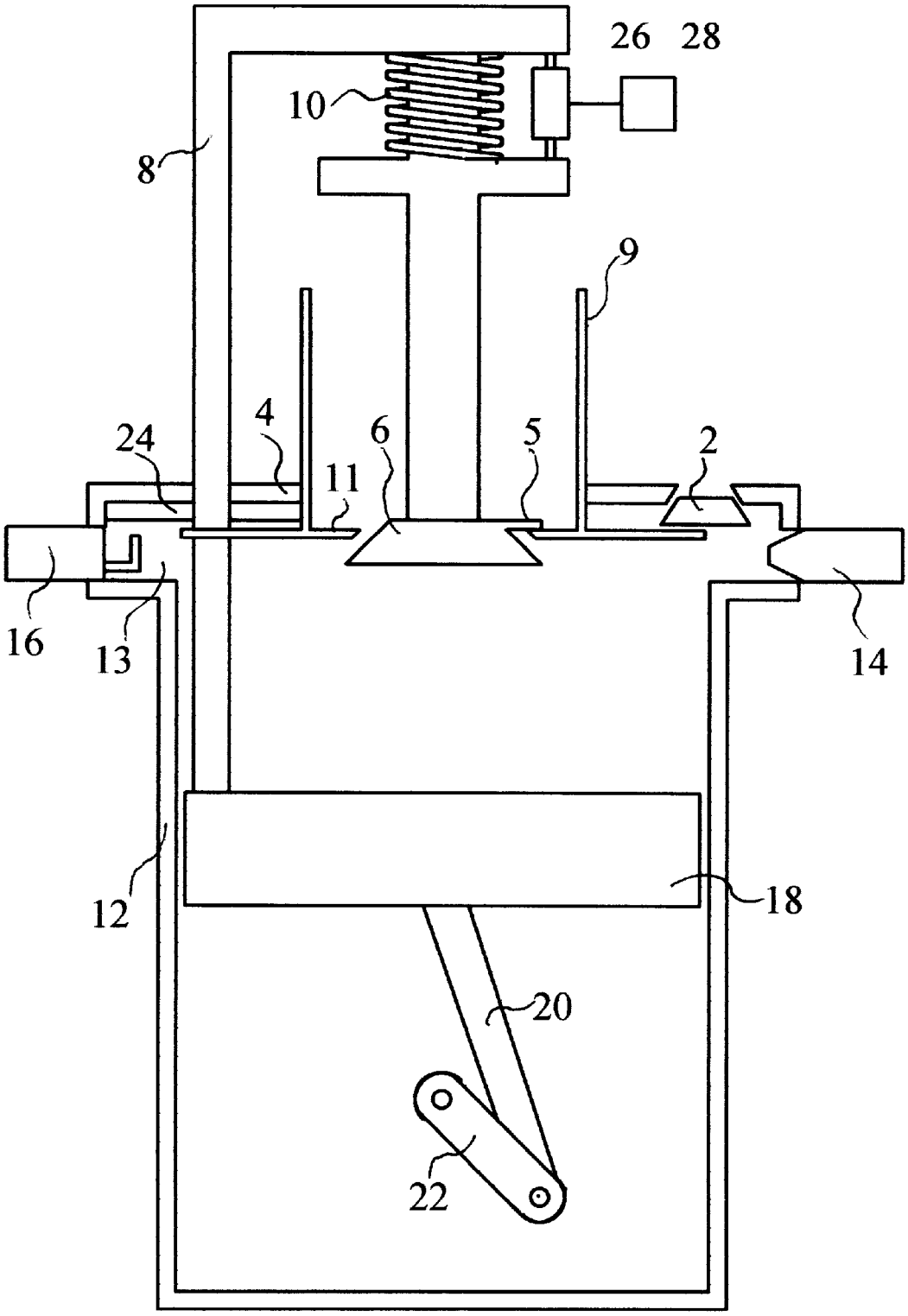

FIG. 7 depicts the second alternate embodiment of the invention. It is the preferred embodiment of the invention with a reshaped displacer 11, exhaust port 34 removed, with spring 10 moved to the outside of the engine, exhaust valve 6, and actuator 8, added. It is at the start of the inlet and exhaust part of the cycle.

Figure 8:
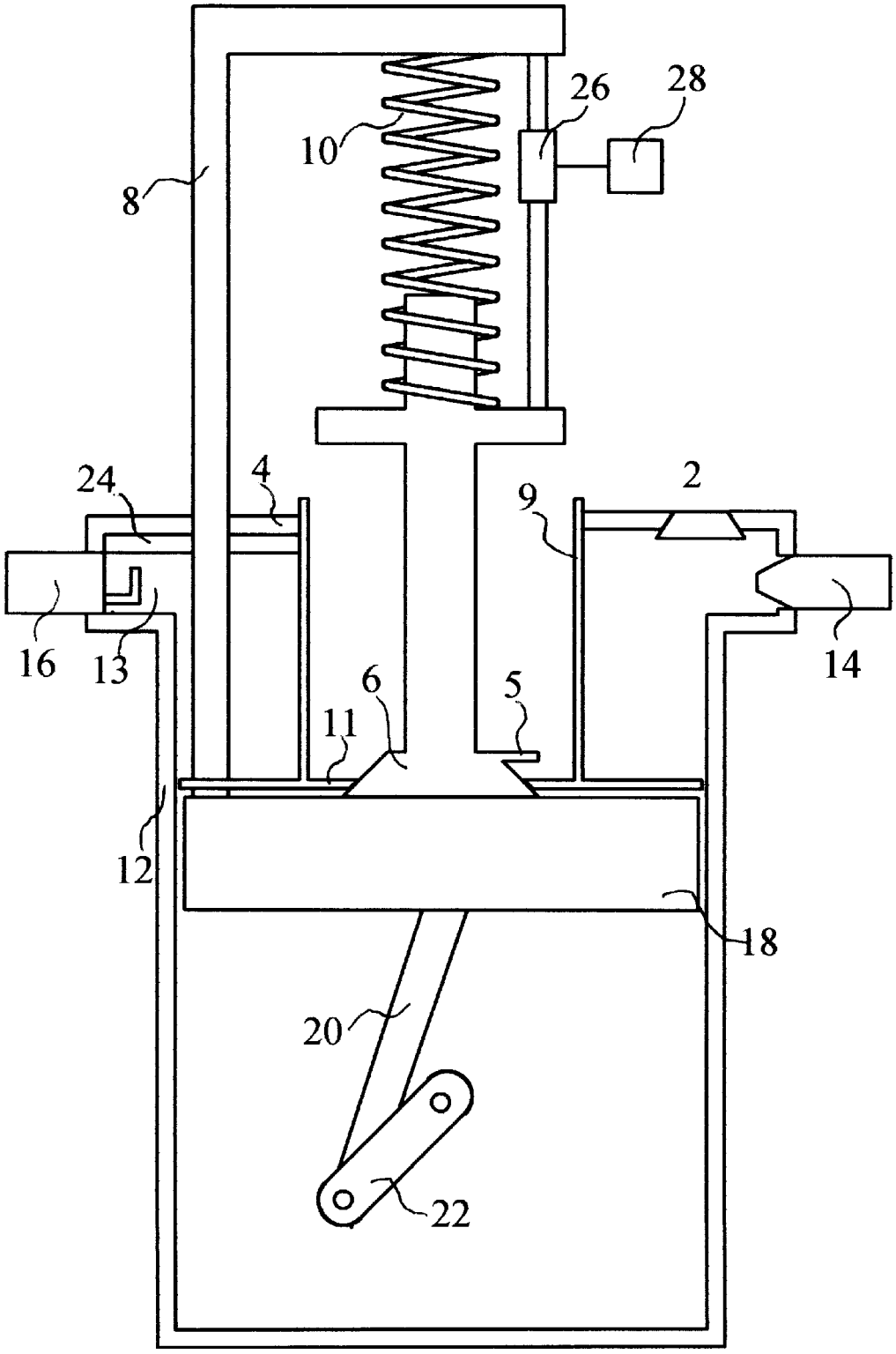

FIG. 8 depicts the second alternate embodiment of the invention. It is at the start of the compression part of the cycle.

Figure 9:
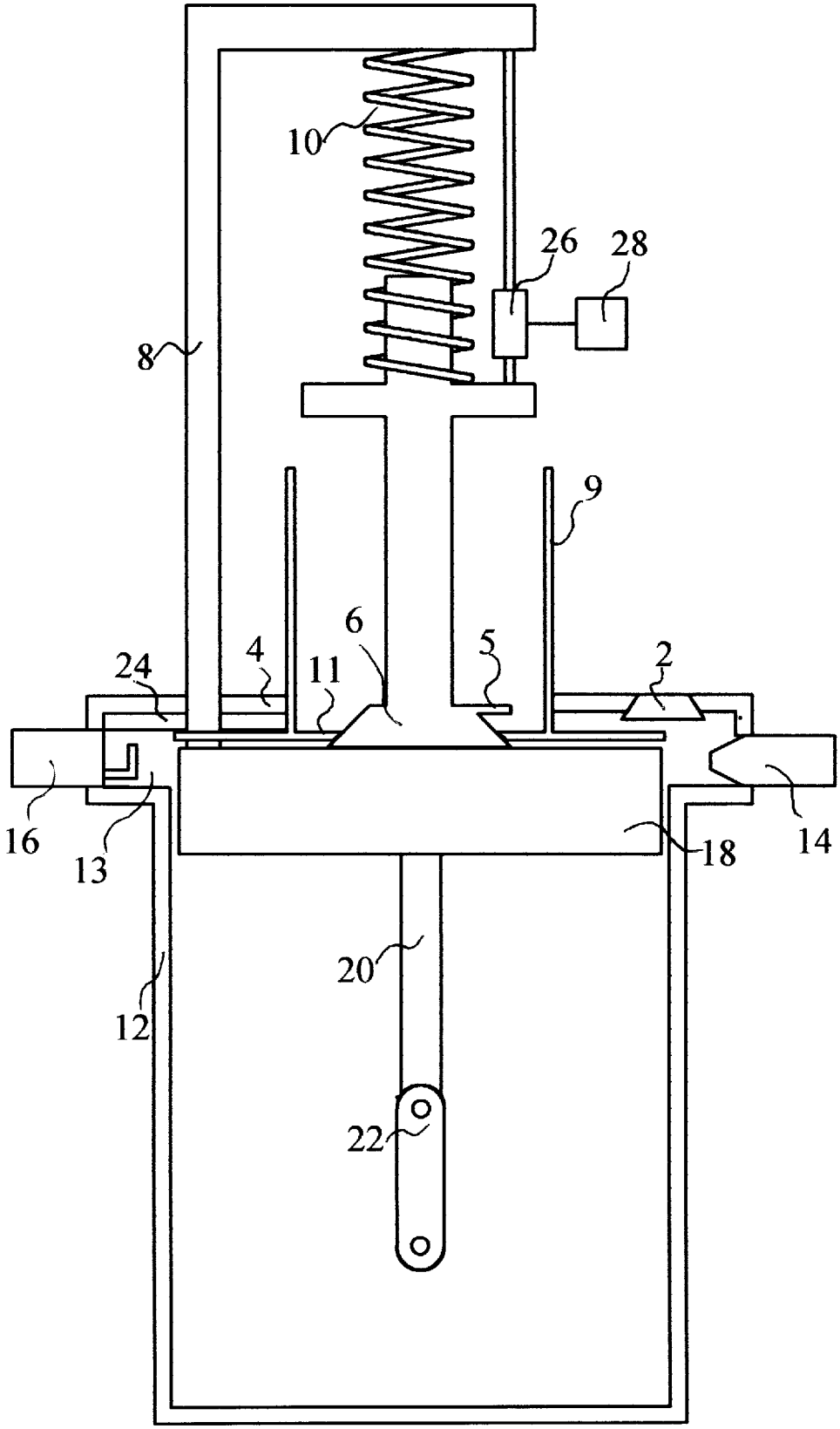

FIG. 9 depicts the second alternate embodiment of the invention. It is at the start of the expansion part of the cycle.

Figure 10:
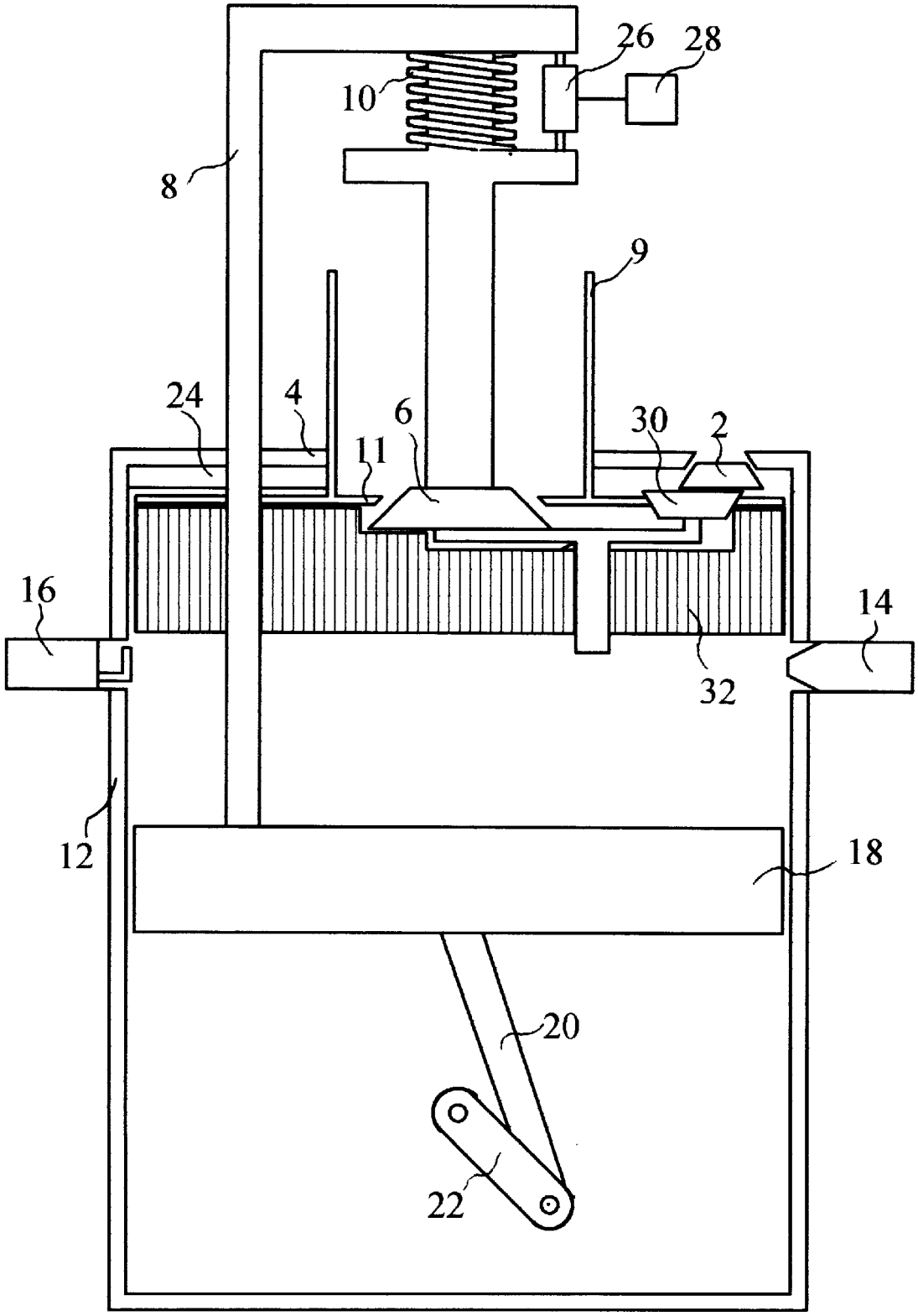

FIG. 10 depicts the third alternate embodiment of the invention. It is the second alternate embodiment of the invention with compression chamber 13 removed, displacer valve 30 and movable regenerator 32 added. It is at the start of the inlet and exhaust part of the cycle.

Figure 11:
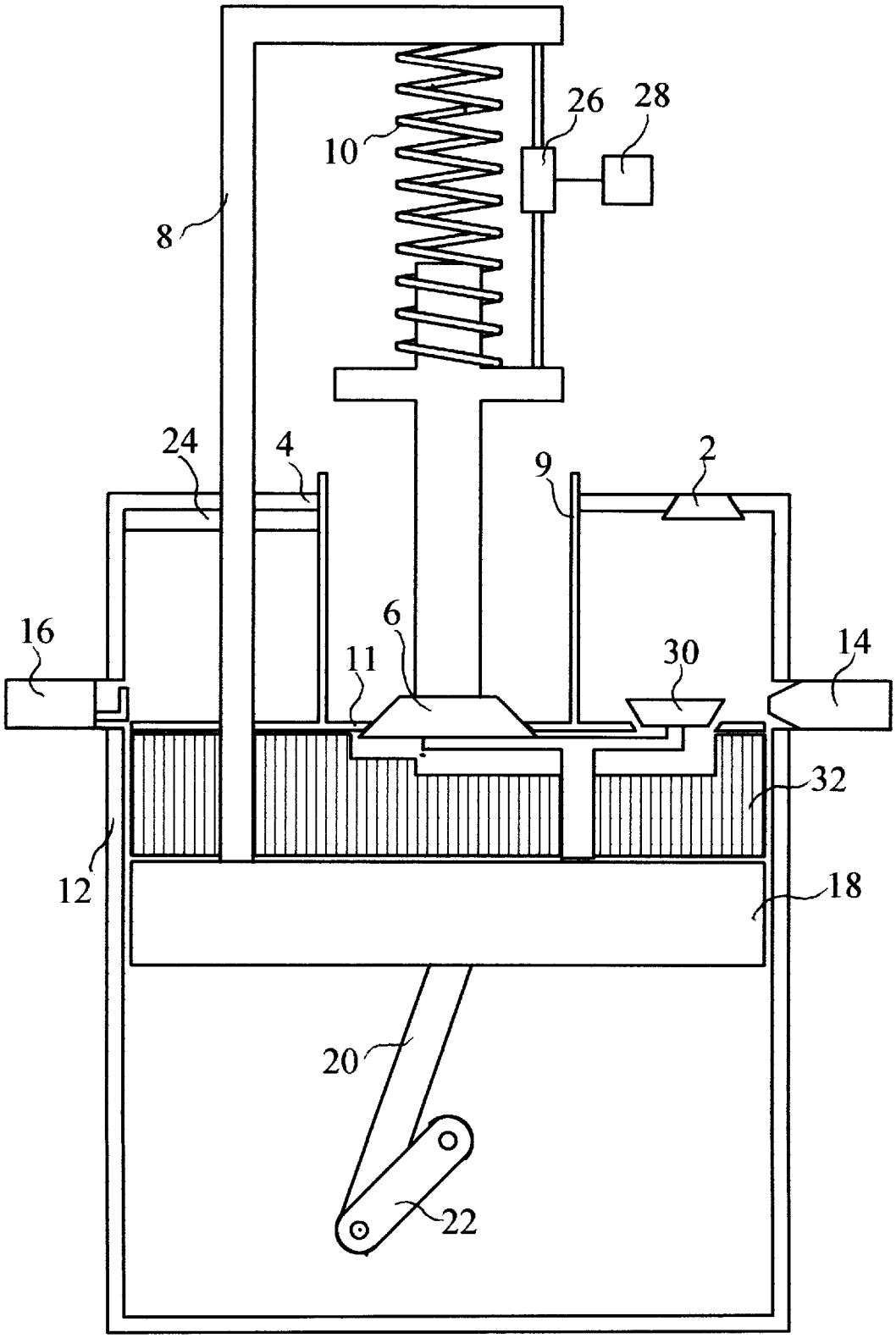

FIG. 11 depicts the third alternate embodiment of the invention. It is at the start of the compression part of the cycle.

Figure 12:
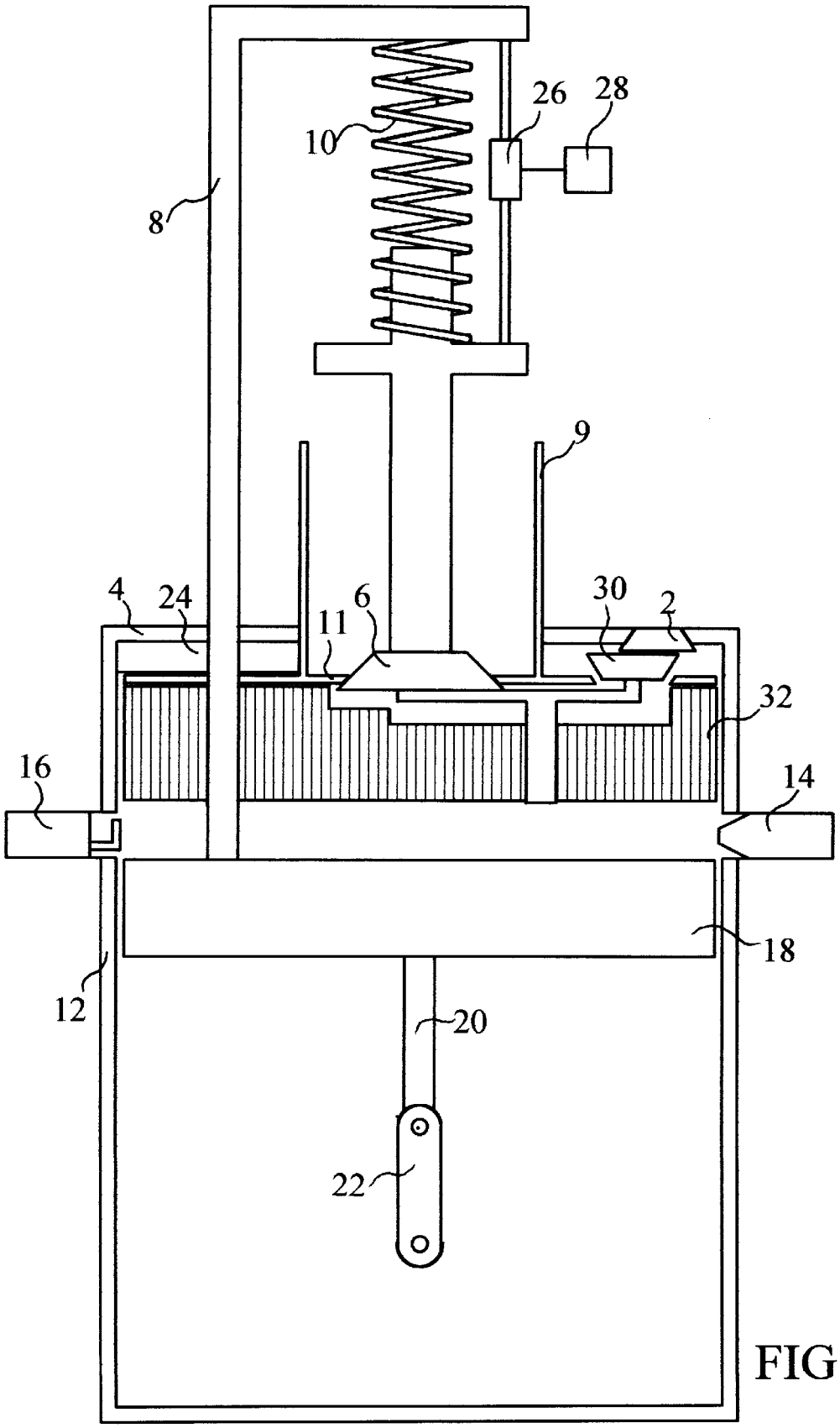

FIG. 12 depicts the third alternate embodiment of the invention. It is at the start of the expansion part of the cycle.

REFERENCE NUMERALS IN DRAWINGS

2 air inlet valve

4 cylinder head

5 tang

6 exhaust valve

8 actuator

9 barrel
10 spring
11 displacer
12 cylinder
13 compressed air chamber
14 fuel injector
16 igniter
18 power piston
20 connecting rod
22 power output shaft
24 cooler
26 damper
28 damper controller
30 displacer valve
32 movable regenerator
34 exhaust port

DESCRIPTION—FIGS. 1 TO 12

This invention is a two stroke, reciprocating, internal combustion engine employing a displacer 11 as described herein. This invention employs a two stroke cycle divided into three parts. The first part is the intake and the exhaust part. The second is the compression part, and the third is the expansion part. In the expansion part, power piston 18 moves from about top dead center to about 85% of its downward travel. The intake and exhaust part is from about 85% of the downward travel of power piston 18 to about 15% of the travel back up. The compression part is from about 15% of the travel back up of power piston 18 to about top dead center. The above positions are all estimates and are given for descriptive purposes only. The actual position a part of the cycle may begin or end at may be different from those set out above.

The working fluid that is expected to be employed in this invention is air; however, this working fluid could be any mixture of gases, liquids, and solids that can undergo an exothermic chemical reaction with the fuel. The working fluid that is introduced into the cylinder is sometimes referred to as air, or as the charge. After the combustion (or other exothermic reaction which provides the power for the engine) the charge is referred to as exhaust gases. The fuel may be any solid, liquid, gas, or combinations of these that can undergo an exothermic reaction with the working fluid.

FIGS. 1–12 illustrate schematically an internal combustion engine suitable for practice of this invention. Only one set of components for such an engine is illustrated; however, what is illustrated will function as a complete engine if it has an inertial load. It will be understood that this is merely representative of one set of components. A plurality of such structures joined together would make up a larger engine. Other portions of the engine are conventional. Thus, the bearings, seals etc. of the engine are not specifically illustrated. The valves illustrated are but one type out of many that could be used. For example exhaust valve 6 could be a rotary disk valve, that when rotated counterclockwise opens and when rotated clockwise closes. Exhaust valve 6 can be any valve that actuator 8 can open when it moves down and close when power piston 18 hits it moving up.

Cylinder 12 is closed at one end by a cylinder head 4 that contains air inlet valve 2. When air inlet valve 2 is open it allows air to be sucked into the cylinder volume located between cylinder head 4 and displacer 11. Cylinder 12 further contains cooler 24; fuel injector 14; (All of the engine embodiments presented herein utilize a fuel injector for introduction of the fuel. While recognizing that this fuel may be introduced by other means, such a fuel injector is included in every embodiment.) power piston 18 which is connected to power output shaft 22 by a connecting rod 20 (for converting the linear motion of the piston to the rotating motion of the shaft); and igniter 16. (All of the engine embodiments presented herein utilize a spark plug for ignition of the fuel. While recognizing that this igniter may only be required for starting, such an ignition source is included in every embodiment.)

Air inlet valve 2 allows air to enter the engine. It can be any of a variety of valves including those referred to as check valves or one way valves. Cooler 24 cools the air as the air is being compressed. Cooling can be accomplished by using cooling coils lining cylinder head 4, or by using any of a variety of off the shelf coolers. Fuel injector 14 can be anything that injects fuel into cylinder 12. Igniter 16 can be anything that ignites the fuel. The expanding gases exert a force on power piston 18, (a cylindrical piston that can move up and down in cylinder 12). That force, exerted on power piston 18 moving it down, is transmitted via connecting rod 20 and power output shaft 22 to a load (not shown). Cylindrically shaped displacer 11 is a movable wall that has a cylinder, barrel 9, connected to it. The diameter of barrel 9 on displacer 11 inside of the engine is one of the factors determining the expansion ratio of the engine.

Spring 10 can be any energy storage means including gravity, a spring, a pneumatic device, or it could also be mechanical deformation of actuator 8. Damper 26, (sometimes called a shock absorber) dampens the motion of the spring and can be mechanical, hydraulic, pneumatic, or electrical. Damper controller 28 controls the damping action of damper 26; thus it controls the speed of displacer 11, and this speed can be one speed going toward power piston 18 and a different speed moving away.

Figure 1:
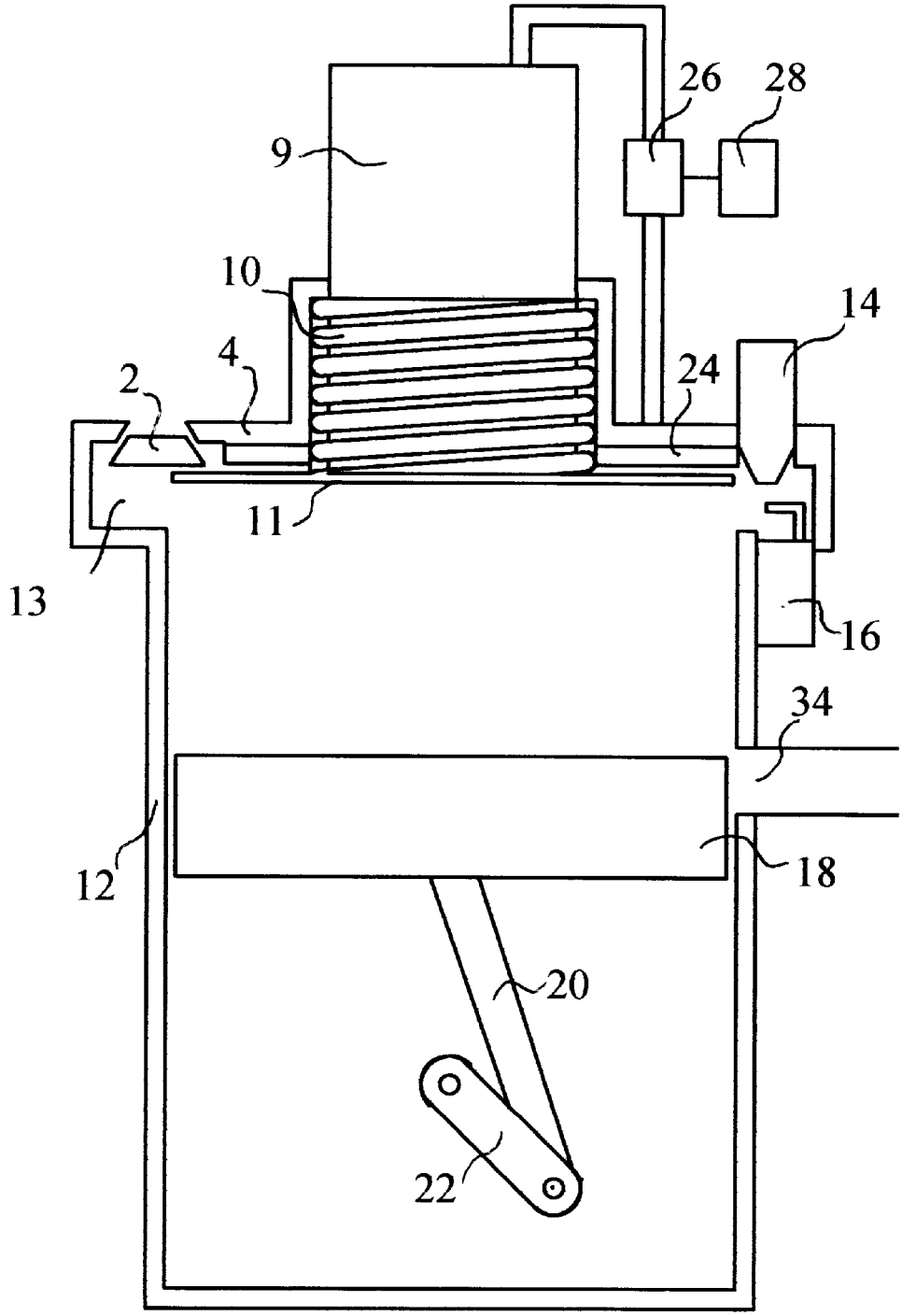
FIG. 1 depicts the preferred embodiment of the invention at the start of the inlet and exhaust part of the cycle.
Figure 2:
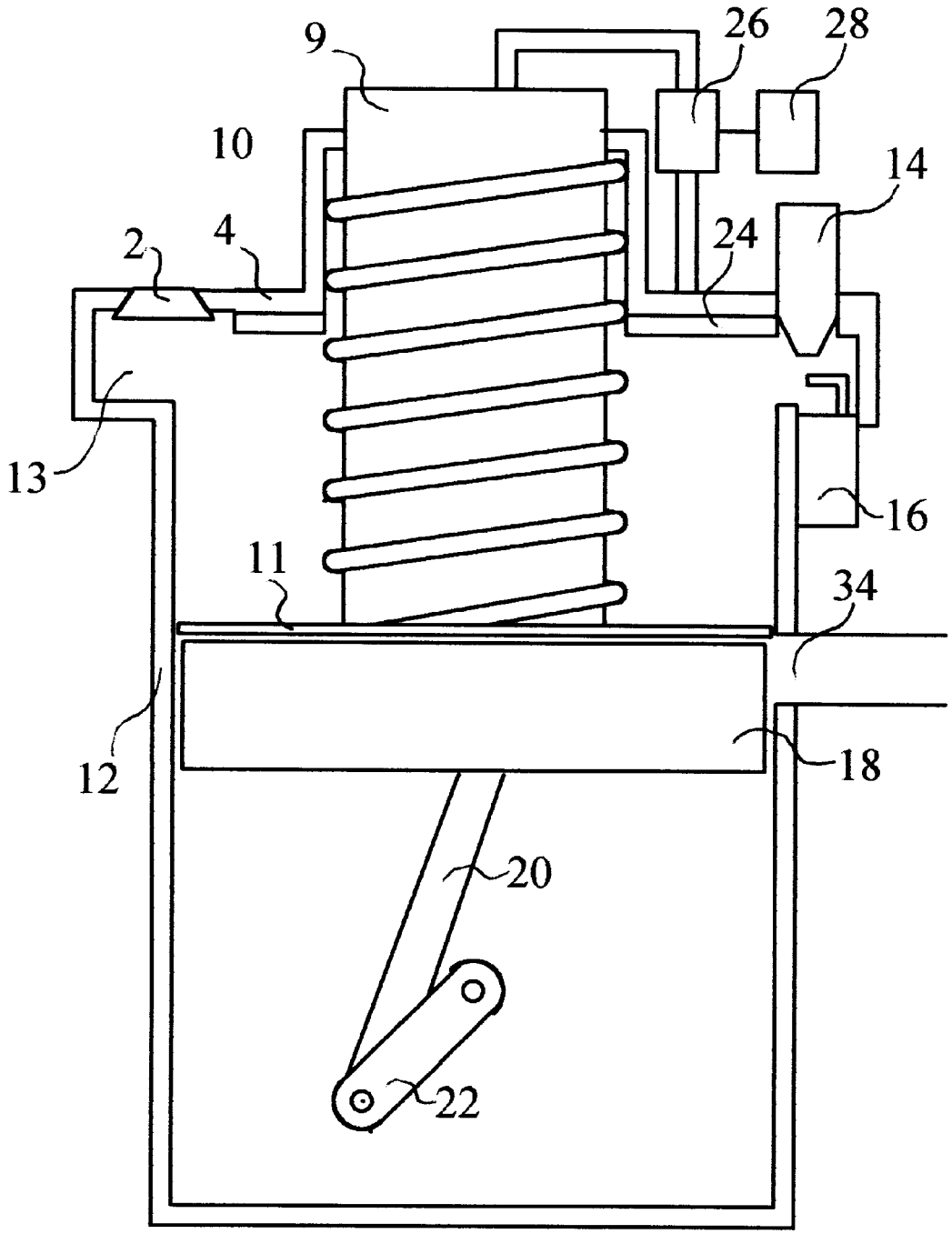
FIG. 2 shows the preferred embodiment of the invention at the start of the compression part of the cycle.
Figure 3:
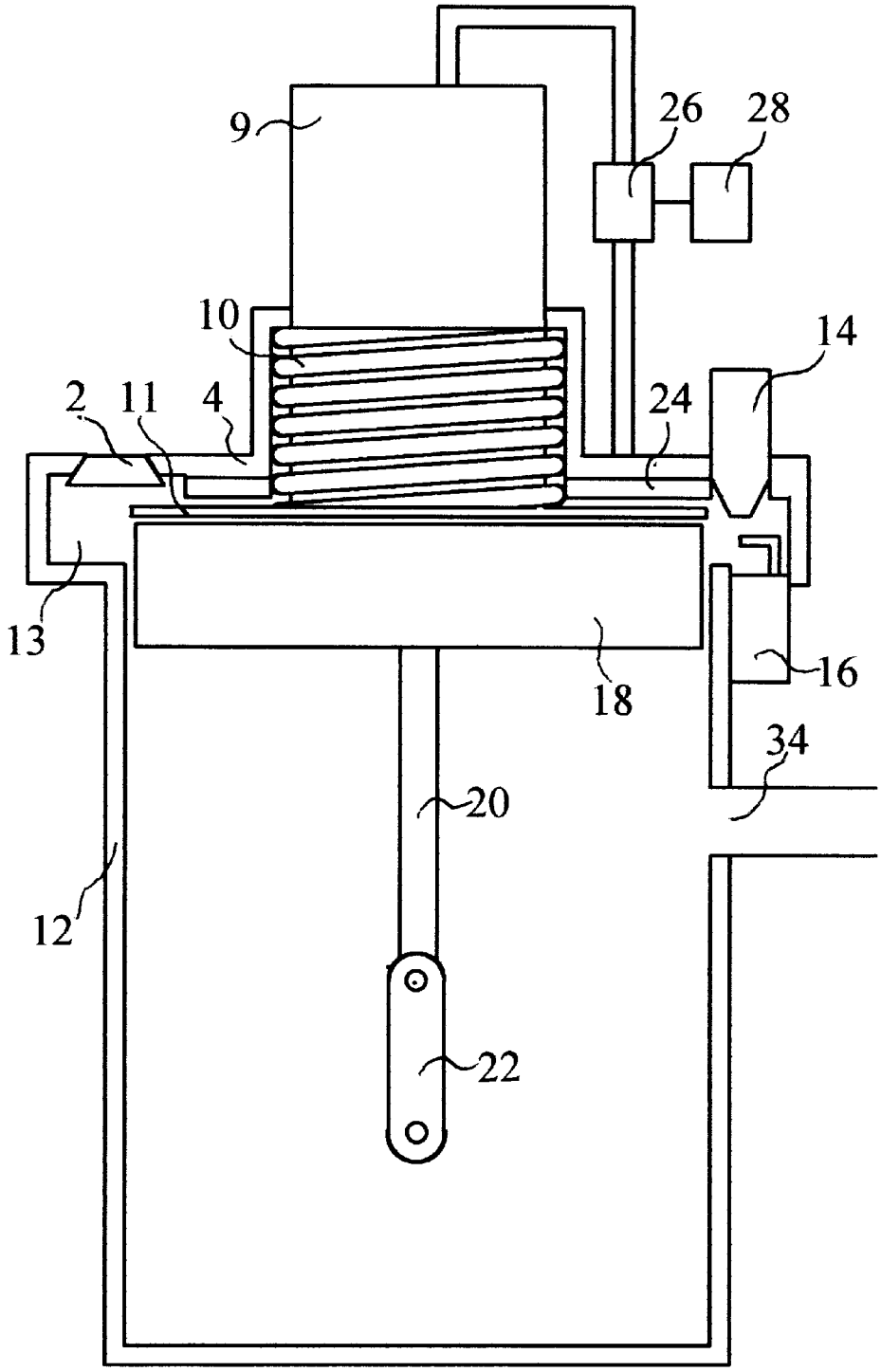
FIG. 3 shows the preferred embodiment of the invention at the start of the expansion part of the cycle.

FIGS. 1 to 3—Description of Preferred Embodiment

FIGS. 1 to 3 represent schematically an internal combustion engine suitable for practice of this invention. FIG. 1 shows the engine as it is about to start an air inlet and exhaust part of the cycle. Cylindrical shaped power piston 18 has just uncovered exhaust port 34, displacer 11 is just starting to move away from cylinder head 4, air inlet valve 2 has just opened and damper 26 is damping the movement of spring 10 as it moves displacer 11.

FIGS. 1 to 3—Operation of Preferred Embodiment

FIGS. 1 to 3 present the sequence of steps or processes occurring in a two stroke engine with displacer. The air intake and exhaust part of the cycle takes place between FIGS. 1 and 2. The compression part of the cycle takes place between FIGS. 2 and 3. The expansion part of the cycle takes place between FIGS. 3 and 1.

FIG. 1 shows power piston 18 at about 85% of downward travel. The engine has completed its expansion part of the cycle and is about to start the intake and exhaust part. When power piston 18 reaches about 85% of downward travel, power piston 18 uncovers exhaust port 34 releasing the pressure in cylinder 12. As spring 10 moves displacer 11 toward power piston 18 exhaust gases are forced out of the engine through exhaust port 34. At the same time air inlet valve 2 opens and air is sucked into the space between displacer 11 and cooler 24.

FIG. 2 shows the engine after displacer 11 and power piston 18 have come together. About the same time as power piston 18 met displacer 11 it recovered exhaust port 34. Air inlet valve 2 has closed, and power piston 18 and displacer 11 will move up together deforming spring 10 and compressing the air between displacer 11 and cooler 24 into compressed air chamber 13.

FIG. 3 shows the engine after the fuel has ignited and the expansion stroke has begun. Power piston 18 will move down providing output power via connecting rod 20 and power output shaft 22. The difference between the pressure inside the engine and the pressure outside the engine will hold air inlet valve 2 closed and displacer 11 against cooler 24 until near the end of the expansion part of the cycle when power piston 18 uncovers exhaust port 34.

Description—FIGS. 4 to 6—First Alternate Embodiment

FIGS. 4 to 6 show the first alternate embodiment of the invention. It is the preferred embodiment of the invention with compression chamber 13 removed and displacer valve 30 added.

FIGS. 4 to 6—Operation of First Alternate Embodiment

FIGS. 4 to 6 present the sequence of steps or processes occurring in the first alternate embodiment of the invention with compression chamber 13 removed and displacer valve 30 added. The air intake and exhaust part of the cycle takes place between FIGS. 4 and 5. The compression part of the cycle takes place between FIGS. 5 and 6. The expansion part of the cycle takes place between FIGS. 6 and 4.

FIG. 4 shows power piston 18 at about 85% of downward travel. The engine has completed its expansion part of the cycle and is about to start the intake and exhaust part. When power piston 18 reaches about 85% of downward travel, power piston 18 uncovers exhaust port 34 releasing the pressure in cylinder 12. As spring 10 moves displacer II toward power piston 18, displacer valve 30 closes and displacer 11 becomes like a moving wall and exhaust gases are forced out of the engine through exhaust port 34. At the same time air inlet valve 2 opens and air is sucked into the space between displacer 11 and cooler 24.

FIG. 5 shows the engine after displacer 11 and power piston 18 have come together. About the same time as power piston 18 met displacer 11, it recovered exhaust port 34. Air inlet valve 2 has closed and displacer valve 30 is about to open as power piston 18 and displacer 11 move up together deforming spring 10 and compressing the air between displacer 11 and cooler 24.

FIG. 6 shows the engine after the fuel has ignited and the expansion stroke has begun. Power piston 18 will move down providing output power via connecting rod 20 and power output shaft 22. The difference between the pressure inside the engine and the pressure outside the engine will hold air inlet valve 2 closed and displacer 11 against cooler 24 until near the end of the expansion part of the cycle when power piston uncovers exhaust port 34. Then the cycle repeats.

Description—FIGS. 7 to 9—Second Alternate Embodiment

FIGS. 7 to 9 show the second alternate embodiment of the invention. It is the preferred embodiment of the invention with exhaust port 34 removed, spring 10 moved to the outside of the engine, and exhaust valve 6 with tang 5 attached to it, and actuator 8, are added.

FIGS. 7 to 9—Operation of Second Alternate Embodiment

FIGS. 7 to 9 present the sequence of steps or processes occurring in the second alternate embodiment of the invention. The air intake and exhaust part of the cycle takes place between FIGS. 7 and 8. The compression part of the cycle takes place between FIGS. 8 and 9. The expansion part of the cycle takes place between FIGS. 9 and 7.

FIG. 7 shows power piston 18 at about 85% of downward travel. The engine has completed its expansion part of the cycle and is about to start the intake and exhaust part. When power piston 18 reaches about 85% of downward travel the end of actuator 8, hits exhaust valve 6 and opens it. Exhaust valve 6 has tang 5 on it that urges along displacer 11 as spring 10 moves displacer 11, and exhaust valve 6 toward power piston 18. As displacer 11, and exhaust valve 6 move toward power piston 18 exhaust gases are forced out of the engine through exhaust valve 6. At the same time air inlet valve 2 opens and air is sucked into the space between displacer 11 and cooler 24.

FIG. 8 shows the engine after displacer 11 and power piston 18 have come together. As power piston 18 met displacer 11 it closed exhaust valve 6 by running into it. Air inlet valve 2 closes and power piston 18 and displacer 11 move up almost together compressing the air between power piston 18 and cooler 24 into compressed air chamber 13.

FIG. 9 shows the engine after the fuel has ignited and the expansion stroke has begun. Power piston 18 will move down providing output power via connecting rod 20 and power output shaft 22. The difference between the pressure inside the engine and the pressure outside the engine will hold air inlet valve 2 and exhaust valve 6 closed and displacer 11 against cooler 24 while spring 10 deforms and until near the end of the expansion part of the cycle when actuator 8 again runs into exhaust valve 6 and opens it. The cycle then repeats.

Description—FIGS. 10 to 12—Third Alternate Embodiment

FIGS. 10 to 12 show the third alternate embodiment of the invention. It is the second alternate embodiment of the invention with tang 5, and compression chamber 13 removed, displacer valve 30 and movable regenerator 32 added to displacer 11.

FIGS. 10 to 12—Operation of Third Alternate Embodiment

FIGS. 10 to 12 present the sequence of steps or processes occurring in the third alternate embodiment of the invention with tang 5 and compression chamber 13 removed and displacer valve 30 and movable regenerator 32 added to displacer 11. The air intake and exhaust part of the cycle takes place between FIGS. 10 and 11. The compression part of the cycle takes place between FIGS. 11 and 12. The expansion part of the cycle takes place between FIGS. 12 and 10.

FIG. 10 shows power piston 18 at about 85% of downward travel. The engine has completed its expansion part of the cycle and is about to start the intake and exhaust part. When power piston 18 reaches about 85% of downward travel the end of actuator 8 hits exhaust valve 6 and opens it and closes displacer valve 30. Displacer valve 30 urges along displacer 11 as spring 10 moves displacer valve 30, exhaust valve 6, displacer 11, and movable regenerator 32 toward power piston 18. As displacer 11, displacer valve 30, exhaust valve 6 and movable regenerator 32 move toward power piston 18 exhaust gases are forced out of the engine through movable regenerator 32, and exhaust valve 6. When the exhaust gases pass through movable regenerator 32 they lose heat and heat up movable regenerator 32. At the same time air inlet valve 2 opens and air is sucked into the space between displacer 11 and cooler 24. The speed at which displacer 11 moves and the point at which it meets power piston 18 is controlled by damper 26 through damper controller 28. The sooner displacer 11 meets power piston 18, after power piston 18 starts back up, the more air enters the engine and the more power the engine is capable of producing. The later displacer 11 meets power piston 18, after power piston 18 starts back up, the slower the exhaust gases move through movable regenerator 32, the less air enters the engine, and the higher the expansion ratio of the engine; hence the more efficient the engine can be.

FIG. 11 shows the engine after displacer 11 and power piston 18 have come together. As power piston 18 met displacer 11 it closed exhaust valve 6 and opened displacer valve 30 by running into them. Air inlet valve 2 closes and power piston 18 and displacer 11 move up almost together compressing the air between power piston 18 and cooler 24. As the air pressure inside the engine becomes greater than the air pressure outside the engine, the pressure difference moves displacer 11 and movable regenerator 32 away from power piston 18 and through the compressed air. When the compressed air moves through displacer valve 30 and movable regenerator 32 it heats up from the heat left behind by the exhaust gases. The speed at which movable regenerator 32 moves up after it leaves power piston 18 is controlled by damper controller 28.

FIG. 12 shows the engine after the fuel has ignited and the expansion stroke has begun. Power piston 18 will move down providing output power via connecting rod 20 and power output shaft 22. The difference between the pressure inside the engine and the pressure outside the engine will hold air inlet valve 2 and exhaust valve 6 closed and displacer 11 against cooler 24 while spring 10 deforms, and until near the end of the expansion part of the cycle when actuator 8 again runs into exhaust valve 6 and opens it. The cycle then repeats.

Conclusion

Accordingly, the reader will see that the two stroke engine with displacer meets the following objects and advantages:

(a) The engine compresses the air in cylinder 12, and the engine expands the charge in cylinder 12.

(b) The engine compresses most of the air in a portion of the cylinder above displacer 11 that is not heated by the hot gases.

(c) The compressed air is cooled by cooler 24.

(d) In the third alternate embodiment of the invention movable regenerator 32 saves the heat from the exhaust gases and releases the heat to the compressed air.

(e) In the third alternate embodiment of the invention all of the engines valves operate at compressed air temperature or only slightly higher.

(f) Displacer 11 pushes out most of the exhaust gases each stroke.

(g) The diameter of the cylindrical part of displacer 11, barrel 9, causes the compressed volume to be smaller than in similar engines so that the engine will operate with the charge more fully expanded.

(h) in the preferred embodiment, the engine has no linkage between displacer 11 and power piston 18.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A two stroke, internal combustion, reciprocating engine having a number of similar working units, each working unit comprising:

a) combustion cylinder closed at one end by a combustion cylinder head and containing a movable power piston which moves in a reciprocating manner and is connected to a power output shaft;

b) a means for exhausting the exhaust gases is located in said combustion cylinder at about 85% of said power piston travel from top dead center;

c) a displacer comprising a movable wall and a barrel, with said movable wall portion located within said combustion cylinder between said power piston and said combustion cylinder head and with said barrel portion of said displacer extending through said combustion cylinder head, said movable wall of said displacer can be moved between said power piston and said combustion cylinder head;

d) a means for one way flow located on said displacer to prevent flow through said displacer when said displacer moves towards said power piston, and to allow flow through said displacer when said displacer moves towards said combustion cylinder head;

e) a means for storing energy during the compression part of the cycle for use in moving said displacer during the exhaust and air intake part of the cycle;

f) a means for permitting the flow of fresh working fluid into said combustion cylinder during the time that said displacer moves toward said power piston;

g) a means for increasing the temperature of the compressed gases.

2. An engine as recited in claim 1 wherein the diameter of said barrel determines the difference between the compression ratio and the expansion ratio of said engine.

3. A two stroke, internal combustion, reciprocating engine having a number of similar working units, each working unit comprising:

a) a combustion cylinder, closed at one end by a combustion cylinder head and containing a movable power piston which moves in a reciprocating manner and is connected to a power output shaft;

b) a displacer comprising a movable wall and a barrel, with said movable wall portion located within said combustion cylinder between said power piston and said combustion cylinder head and with said barrel portion of said displacer extending through said combustion cylinder head and forming an exhaust pipe, said movable wall of said displacer can be moved between said power piston and said combustion cylinder head;

c) a means for exhausting the exhaust gases located on said displacer to permit the flow of exhaust gases from said combustion cylinder when said displacer moves towards said power piston, and prevent the flow of exhaust gases from said combustion cylinder at all other times;

d) a means for one way flow located on said displacer to prevent flow through said displacer when said displacer moves towards said power piston, and allow flow through said displacer when said displacer moves towards said combustion cylinder head;

e) a means for storing energy during the expansion part of the cycle for use in moving said displacer during the exhaust and air intake part of the cycle;

f) a means for permitting the flow of fresh working fluid into said combustion cylinder during the time that said displacer moves toward said power piston;

g) a linkage between said power piston and said means for exhaust that opens said means for exhaust as said power piston nears the end of its expansion stroke;

h) a means for increasing the temperature of the compressed gases.

4. An engine as recited in claim 3 wherein said means for storing energy has a means for damping attached to it.

5. An engine as recited in claim 3 wherein the diameter of said barrel determines the difference between the compression ratio and the expansion ratio of said engine.

6. An engine as recited in claim 3 wherein said combustion cylinder head contains a means for cooling.

7. An engine as recited in claim 3 wherein said displacer houses a thermal regenerator; said regenerator being an alternating flow heat exchanger which moves with said displacer between said combustion cylinder head and said power piston, and stores heat from exhaust gases as it moves towards said power piston, and releases heat to the compressed air as said regenerator moves away from said power piston.

8. A process for operating a two stroke engine, with a displacer without one way flow means and with exhaust means located in the combustion cylinder wall, having the following steps:

a) when the power piston is near the end of its expansion stroke, said means for exhaust opens, pressure inside of said engine decreases, and a means for storing energy releases its energy and starts the movement of said displacer toward said power piston, exhaust gases are expelled from said combustion cylinder, the means for air intake opens and fresh working fluid is sucked into said combustion cylinder;

b) said power piston moves through its bottom dead center position and starts back up, while said displacer continues its downward exhaust and air intake stroke;

c) said displacer collides with said power piston and reverses to an upward movement being urged along by said power piston, said means for exhausting the exhaust gases close, said means for air intake close, thereby ending the exhaust and intake part of the cycle;

d) said power piston and said displacer move up toward the combustion cylinder head, thereby storing energy in said means for storing energy and performing a compression stroke whereby the working fluid trapped in said combustion cylinder is compressed;

e) the difference between the pressure inside and the pressure outside of said engine forces said displacer up to the top of said combustion cylinder adjacent to said combustion cylinder head displacing the compressed air into a compressed air chamber;

f) when said power piston nears the top of its stroke, the means for increasing the temperature heats up the charge and said power piston begins its expansion stroke;

g) the difference in pressure between the inside and outside of said engine causes said displacer to remain adjacent to said combustion cylinder head while said power piston moves away from said combustion cylinder head;

h) the cycle repeats.

9. A process for operating a two stroke engine, with a displacer with one way flow means and with exhaust means located in the combustion cylinder wall, having the following steps:

a) when the power piston is near the end of its expansion stroke, said means for exhaust opens, pressure inside of said engine decreases, and a means for storing energy releases its energy and starts the movement of said displacer toward said power piston, exhaust gases are expelled from said combustion cylinder, and at the start of said stroke the means for one way flow through said displacer closes, the means for air intake opens and fresh working fluid is sucked into said combustion cylinder;

b) said power piston moves through its bottom dead center position and starts back up, while said displacer continues its downward exhaust and air intake stroke;

c) said displacer collides with said power piston and reverses to an upward movement being urged along by said power piston, said means for exhausting the exhaust gases close, said means for air intake close, and said one way flow means through said displacer opens;

d) said power piston and said displacer move up toward the combustion cylinder head, thereby storing energy in said means for storing energy and performing a compression stroke whereby the working fluid trapped in said combustion cylinder is compressed;

e) the difference between the pressure inside and the pressure outside of said engine forces said displacer up to the top of said combustion cylinder adjacent to said combustion cylinder head;

f) when said power piston nears the top of its stroke, the means for increasing the temperature heats up the charge and said power piston begins its expansion stroke;

g) the difference in pressure between the inside and outside of said engine causes said displacer to remain adjacent to said combustion cylinder head while said power piston moves away from said combustion cylinder head;

h) the cycle repeats.

10. A process for operating a two stroke engine, with a displacer and with exhaust means located on said displacer, having the following steps:

a) when the power piston is near the end of its expansion stroke, the linkage between said power piston and said exhaust means opens said exhaust means and closes the means for one way flow through said displacer, then the means for storing energy releases its energy and starts movement of said displacer, exhaust gases are expelled from said combustion cylinder through a regenerator, heating said regenerator, and in the same stroke a means for fresh air intake opens and fresh working fluid is sucked into said combustion cylinder;

b) said power piston moves through its bottom dead center position and starts back up, while said displacer continues its downward exhaust and air intake stroke;

c) said displacer collides with said power piston and reverses to an upward movement being urged along by said power piston, said means for exhausting the exhaust gases closes as a result of the collision with said power piston, the means for one way flow through said displacer opens, and said means for air intake closes, thereby ending the exhaust and intake part of the cycle;

d) said power piston and said displacer move up toward the combustion cylinder head performing a compression stroke whereby the working fluid trapped in said combustion cylinder is compressed;

e) the difference in pressure between the inside and outside of said engine causes said displacer to move to the top of said combustion cylinder adjacent to said combustion cylinder head, as said displacer moves away from said power piston the compressed air moves through said regenerator heating the compressed air with heat left behind by the exhaust gases, f) when said power piston nears the top of its stroke, said means for increasing the temperature heats up the charge and said power piston begins its expansion stroke, the difference in pressure between the inside and outside of said engine causes said displacer to remain adjacent to said combustion cylinder head while said power piston moves away from said combustion cylinder head; at the same time energy is stored in said means for storing energy;

g) the cycle repeats.

* * * * *